United States Patent [19]

Guthrie et al.

[11] Patent Number: 4,643,378

[45] Date of Patent: Feb. 17, 1987

[54] ROLLER-CHOCK CLIMBING AID

[76] Inventors: Karl Guthrie, 180 Goldenridge Dr., Apt. A, Sebastopol, Calif. 95472; Joseph Schwartz, 22980 Wallig Rd., Geyserville, Calif. 95441

[21] Appl. No.: 770,017

[22] Filed: Aug. 29, 1985

Related U.S. Application Data

[63] Continuation-in-part of Ser. No. 713,020, Mar. 18, 1985, abandoned.

[51] Int. Cl.[4] ..... A63B 29/08

[52] U.S. Cl. ..... 248/1; 248/317; 248/231.9

[58] Field of Search ..... 248/1, 200, 231.2, 231.9, 248/317; 294/96, 94

[56] References Cited

U.S. PATENT DOCUMENTS

| | | | |
|---|---|---|---|
| 3,903,785 | 9/1975 | Pepper, Jr. | 248/1 |
| 4,572,464 | 2/1986 | Phillips | 248/1 |

FOREIGN PATENT DOCUMENTS

| | | | |
|---|---|---|---|
| 0047232 | 10/1982 | European Pat. Off. | 248/1 |
| 2911952 | 10/1980 | Fed. Rep. of Germany | 248/1 |
| 2440206 | 7/1980 | France | 248/1 |

OTHER PUBLICATIONS

Royal Robbins, *Advanced Rockcraft*, 1973, pp. 15–33.

*Primary Examiner*—Ramon S. Britts
*Assistant Examiner*—Karen J. Chotkowski
*Attorney, Agent, or Firm*—Allston L. Jones

[57] ABSTRACT

A self-wedging, variable thickness climbing aid for rock climbing. The device includes a wedge-shaped chock to which an anchor cable is affixed with that cable extending from the thin end of the chock with an anchor loop on that end. A roller is attached adjacent one of the broad faces of the chock by means of springs between the ends of the roller and the adjacent sides of the chock. Further, a release cable is attached to each end of the roller for the user to draw the roller down the face of the chock to thin the overall device to permit its insertion or removal from a crack in the rock.

15 Claims, 16 Drawing Figures

ROLLER-CHOCK CLIMBING AID

This is a continuation-in-part of application Ser. No. 713,020 filed Mar. 18, 1985, now abandoned.

BACKGROUND OF THE INVENTION

The present invention relates to devices for fastening to rock, and more particularly to removable rock anchors for use in the sport of mountain climbing.

In the sport of mountain climbing, climbers rely on the use of safety ropes which are removably secured to the face of the rock at selected points during the climb, and during the climb the rope is advanced from one attachment point to the next. The rope may be secured to the rock either directly, or by means of a variety of available devices. There are two types of attachment means for use in rock climbing: those which are permanently affixed to the face of the rock, and those that are removable and reusable as the climb progresses.

The devices for permanent attachment include pitons and bolts which are driven into the rock to which the safety rope is slidably affixed. This requires that the climber not only carry the heavy pitons, enough for the entire climb, but also heavy tools for driving them into the rock. Additionally, these devices have negative safety and esthetic value. With time the pitons rust, stain the face of the rock and grow weak. The rust weakened pitons then provide a questionable anchor to subsequent climbers, and could break off and be the resultant cause of injury to a climber that chooses to rely on them.

In recent years, climbers have been increasingly concerned with the safety and esthetic problems with pitons, and have been seeking ways to make "clean" climbs. To this end, a number of removable and reusable climbing devices have appeared on the market.

These include a variety of climbing chocks of various shapes that are forced into a crack and have a hole through them for receiving a rope. These can be hard and time-consuming to place since the climber may only have a limited number of sizes of chocks with him on the climb, the available cracks may be too large or small to properly accomodate those sizes, and chocks have no moving parts to ease their placement while the climber holds onto the face of the rock with his toes and fingertips. Once placed, they nearly always require the use of a chock clean-up tool to break them free so that they can be recovered. U.S. Pat. No. 4,442,607 discloses a typical climbing chock.

Another device which is known to rock climbers as a "friend" is disclosed in U.S. Pat. No. 4,184,657. This device includes a support bar, a spindle mounted on the support bar, two pairs of cam members pivotally mounted on the spindle adapted for opposite pivotal movement from a "closed" position to an "open" position, and spring members mounted on the spindle between each pair of cam members which act to apply force to each cam member to urge it into its open position. An operating bar is slidably mounted on the support bar and is connected to each cam member, there being at the opposite end of the support bar to the spindle an attachment point for a climbing rope. By pulling the operating bar away from the spindle puts the cams into the "closed" position so that the climbing aid can be inserted into a crack formed in rock or the like. Once placed, the bar is then released and the spring members force the cams into their "open" position to lock the climbing aid within the crack. The support bar may also include means to hold the operating bar in a position where the cam members are in the "closed" position. The "friend" presents a problem in that it can only be used in fairly large cracks in the rock as a result of the diameter of the cams, the number of cams, and the spacing between those cams. A major drawback to this device is that once placed in a crack, it has a tendency to walk into the crack, which in some cases makes retrieval impossible since the operating bar can no longer be reached to "close" the cams for removal. The loss of only a few of these devices on a climb can quickly make that climb expensive due to the substantial cost of these devices.

Yet another device which has recently been introduced is a two section chock in the shape of a parallelogram when the two sections are aligned one with the other. One chock section is affixed to one end of an anchor cable with the other end of the cable folded back and clamped to itself to form an anchor loop. The other chock section is mounted on a second cable with its other end connected to a disk which surrounds the anchor cable so that the two cables are parallel to each other. There also is a coil spring around the anchor cable between the loop and the disk to bias the other chock section upward. Further, there is a plastic sleeve around both cables adjacent the disk to protect them and to limit the extent to which the spring can bias the other chock section upward. This is limited so that no less than one-half of each chock section is adjacent the other at all times. Finally, to maintain the two chock sections in a juxtaposed position, they are dove-tailed together. Thus, by pulling the disk toward the anchor loop, the other chock section slides past the one chock section thus making the effective combined thickness of the two chock sections variable. This permits the thinning of the combined chock for insertion into a crack and then the thickening of the combined chock when the disk is released. In this design, the long parallel face of each chock section makes contact with the inner surfaces of the crack, usually at a single point on each face. The points of contact tend to be uneven and unsymmetrical from one face to the other due to the unevenness of the faces of the crack. As the climber advances up the face of the rock while using these anchoring devices, his safety rope may pull on the anchor loop causing rotation of the chock about its faces. In doing so, these devices often become unwedged and therefore useless to the climber should he fall after climbing past such a placement. In addition, if a fall occurs and a wedged one of these devices breaks that fall, the chock sections may twist making its recovery very difficult, if at all, only with the use of a hammer and punch, wherein the hammer and punch represent extra weight that a climber would rather not carry. If this device is not recoverable and must be left behind, it too represents an expensive permanent placement, much more expensive than simple pitons. Further, these devices have been found not to work well in flaring cracks and they have a tendency to slip in smooth cracks on their smooth faces.

What is needed is a variable thickness chock design that can be made in a variety of sizes and widths, one that is easily placed and can be used in all types and orientations of cracks including flaring cracks, one that can be placed without having to view the crack while doing so, one that maintains its wedge when the anchor loop is pulled as the climber climbs around the point of placement, and one that is easily retrievable when the clean-up man reaches the placement. The present invention provides such a device.

SUMMARY OF THE INVENTION

In accordance with the illustrated embodiment, the present invention provides a self-wedging, variable thickness rock climbing aid. The climbing aid of the present invention includes a wedge-shaped chock having two broad faces, two narrow sides, and a thick and a thin end. Affixed to the thin end of the chock is an anchor cable means which defines an anchor loop at its other end which is disposed to be clipped to the safety rope of the climber. The present invention also includes a cylindrical roller adjacent one broad face of the chock with spring means for retaining the roller adjacent that face of the chock and for biasing the roller toward the thick end of the chock. Further included is a secondary cable means for manually drawing the roller down the face of the chock to reduce the overall thickness of the climbing aid to facilitate its placement in or withdrawal from a crack in the rock.

DESCRIPTION OF THE PREFERRED EMBODIMENT

Figure 5A:
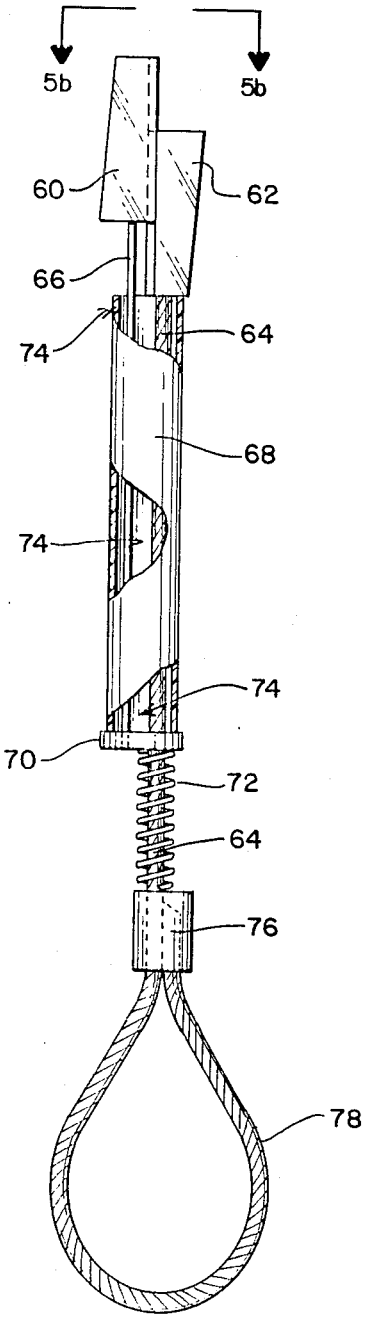
FIG. 5a PRIOR ART
FIG. 5*a* shows a plan view of a two section prior art chock.
Figure 5B:
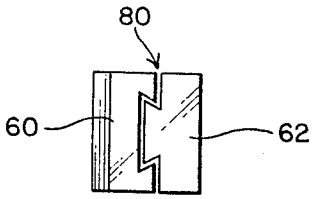
FIG. 5b PRIOR ART
FIG. 5*b* shows the construction detail of the interconnection of the two chock sections of the prior art chock of FIG. 5*a.*

Referring to FIGS. 5*a* and 5*b,* there is shown the two section chock of the prior art. This device includes chock sections 60 and 62 which are interconnected one to the other by dove-tail 80. One end of anchor cable 64 is attached to chock section 62 with the other end of anchor cable 64 looped back and clamped to itself by means of cable clamp 76 forming anchor loop 78. Secondary cable 66 runs between chock section 60 and disk 70 which is mounted on anchor cable 64 between chock section 62 and cable clamp 76. Juxtaposed to and extending a selected length away from disk 70 is a plastic sleeve 68 which surrounds anchor cable 64 and secondary cable 66. In addition, a spring 72 is mounted on anchor cable 64 between disk 70 and cable clamp 76 to bias disk 70 toward chock section 62 and thus biasing chock section 60 away from anchor loop 78. The maximum extent to which chock section 60 extends from anchor loop 78 is limited by the upper end of sleeve 68 coming into contact with the lower end of chock section 62. By manually pulling disk 70 toward cable clamp 76, chock section 60 is drawn downward along chock section 62 with its lowest extent being determined by the normal spacing between disk 70 and cable clamp 76. In FIG. 5*a,* cutouts 74 are provided in sleeve 68 merely to show cables 64 and 66. These cutouts are not present in the finished article.

To use this device, one would pull disk 70 toward cable clamp 76 which in turn draws chock section 60 downward, thus reducing the overall combined width of chock sections 60 and 62 to permit placement of the device within a crack. When disk 70 is released, chock section 60 is again biased upward with the upward extent being limited by the thickness of the crack or sleeve 68. Note that the shortcomings of this device have been discussed above in the Background.

The two embodiments of the present invention are shown in FIGS. 1–4 and 6–8 with the same reference numbers are used for the same components in each of those figures. Referring first to FIGS. 1*a,* 1*b,* 6*a* and 6*b,* there are shown side and front plan views of the two embodiments of the present invention. The roller-chock of the present invention includes a wedge-shaped chock 10 with a loop of heavy steel cable passing through the chock and being fastened back on itself by means of cable clamp 36 forming anchor cable 26 with an anchor loop 34 at its end away from chock 10 with the thinnest portion of its wedge-shape nearest anchor loop 34. To prevent chock 10 from sliding down cable 26, the upper loop of cable 26 is epoxied to the top surface of chock 10 at 28. Chock 10 further includes an upper lip 12 which will be discussed further below. For the first embodiment of FIGS. 1*a* and *b,* attached adjacent to the lip 12 side of chock 10 is a solid roller 14. Roller 14 is interconnected with chock 10 by means of springs 20 extending between chock spring mounting pins 16 and roller spring mounting pins 18 on each side or end of chock 10 and roller 14, wherein pins 16 and 18 are pressed into place. Also attached to roller spring mounting pins 18 is a wire bail 22. At the center of bail 22, release cable 24 is connected and extends downward therefrom through guide tubes 30 which are mounted on anchor cable 26 with release cable 24 terminating in a pull ring at the end of anchor cable 26 adjacent anchor loop 34. In addition, a plastic sleeve could be added to enclose both cables to minimize abrasive wear on each of them. Such a sleeve could extend from chock 10 to cable clamp 36.

Figure 6A:
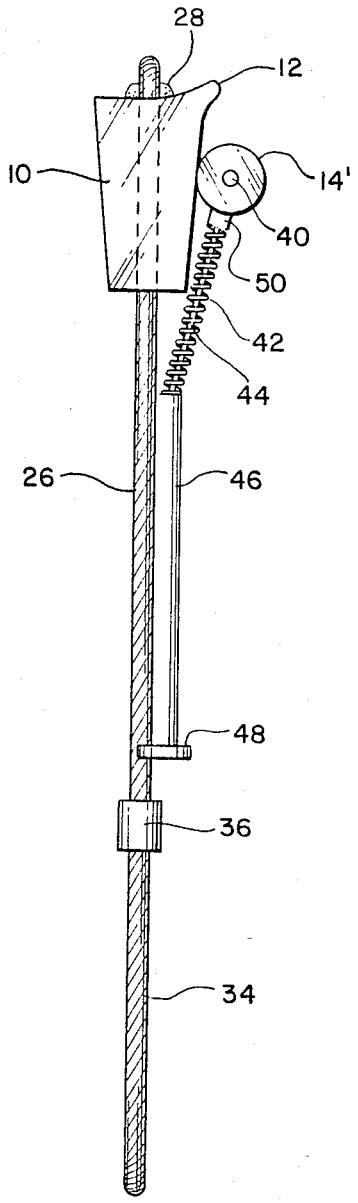
FIGS. 6*a* and 6*b* are side and front plan views of the second embodiment of the present invention, respectively.
Figure 6B:
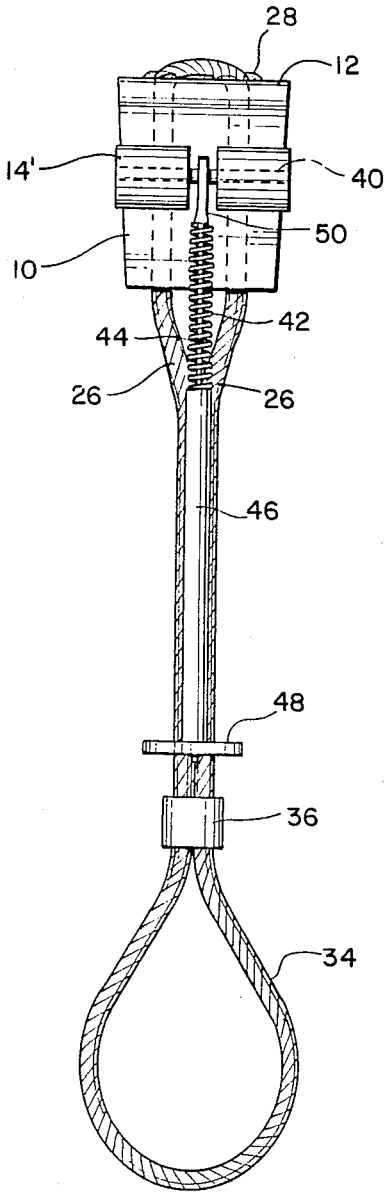

For the second embodiment of FIGS. 6*a,* 6*b,* 7*a* and 7*b,* a bifurcated roller 14' is disposed adjacent the lip 12 side of chock 10. The two halves of roller 14' are mounted axially on opposite ends of a pin 40 with a roller coupler 54 captured on pin 40 between the two roller 14' halves. In turn, release cable 44 is attached to the lower end of roller coupler 54 and extends downward along anchor cable 26 toward cable clamp 36 passing through tube 46. At the cable clamp 36 end of release cable 44 a release grip 48 is attached. Between the upper end of tube 46 and the lower end of roller coupler 50, release cable 44 is enclosed within coil spring 42. Spring 42 biases roller 14' upward toward lip 12, adjacent the face of chock 10 by pushing the lower end of roller coupler 50 upward away from the top of tube 46 with the full extent of travel limited by release cable 44 pulling release grip 48 upward until it comes into contact with the lower end of tube 46.

Figure 1A:
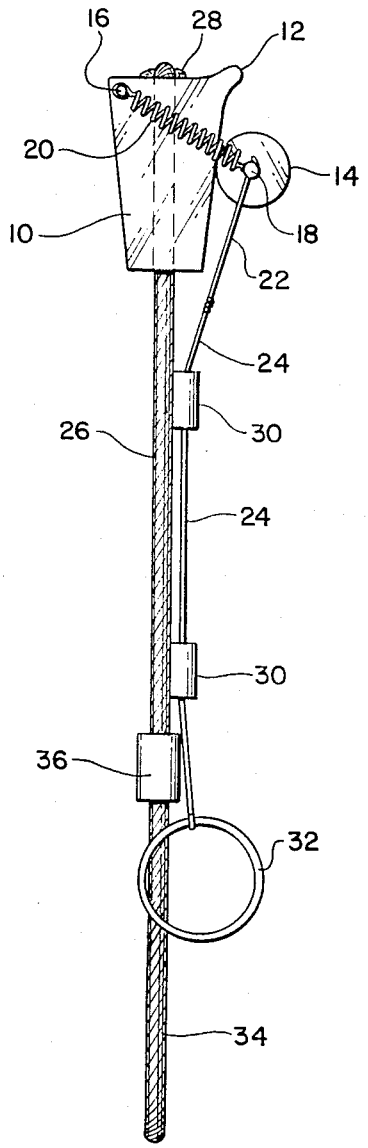
FIGS. 1*a* and 1*b* are side and front plan views of the first embodiment of the present invention, respectively.
Figure 1B:
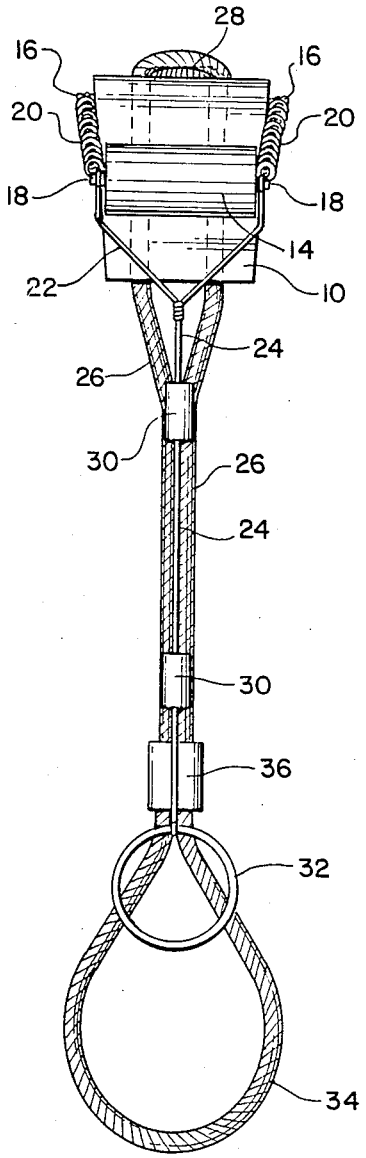
Figure 2:
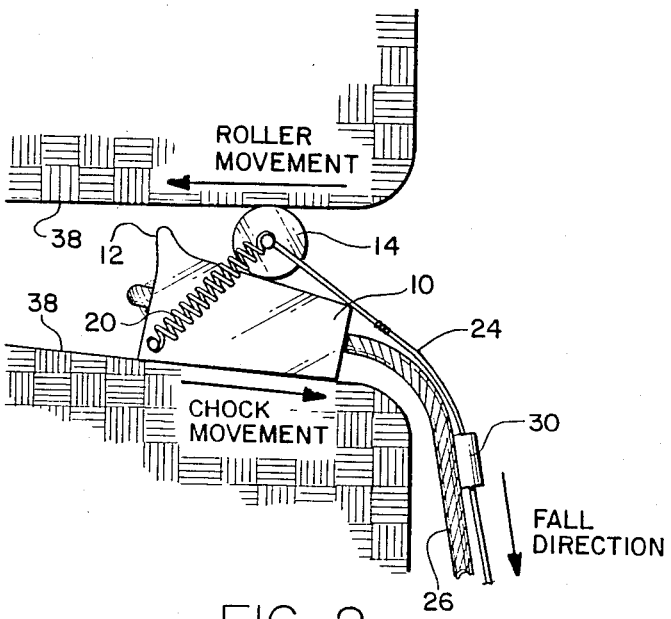
FIG. 2 shows the first embodiment of the present invention of FIGS. 1*a* and *b* in use in a substantially horizontal crack.
Figure 3:
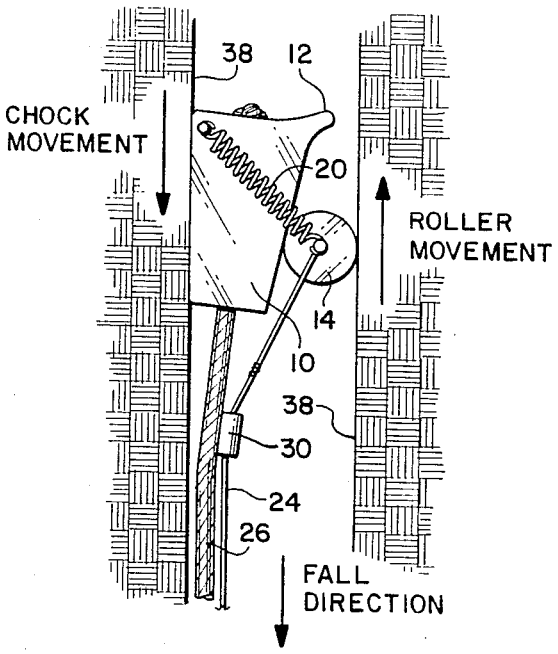
FIG. 3 shows the first embodiment of the present invention of FIGS. 1*a* and *b* in use in a substantially vertical crack.

To place a roller-chock within a crack in the face of the rock being climbed, the climber pulls down on ring 32, or release grip 48, thus drawing roller 14 down the side of chock 10 against the biasing force of springs 20, spring 42, respectively. By doing so, roller 14, or 14 is drawn to a section of chock 10 which is thinner than the uppermost portion, thus reducing the effective thickness of the combination of roller 14, or 14 and chock 10 to permit placement of the combined device within a crack in the face of the rock. Once inserted into the crack, pull ring 32, or release grip 48, is released allowing spring 20 to draw roller 14 up toward the upper end of chock 10, or release grip 48 is released allowing spring 42 to push roller 14' upward toward the upper end of chock 10, and thus wedging the roller-chock within the crack. To set roller-chock in place, anchor cable 26 is given a tug, then the climber clips his safety rope to anchor loop 34 and he is off. In FIGS. 2 and 3, a horizontal and vertical placement is shown, respectively. In these figures, the direction of fall is indicated along anchor cable 26 as well as the directions in which chock 10 and roller 14 would move if they could when cable 26 is under tension. In both of these figures, it can be seen that as more weight is applied to anchor cable 26, roller 14 tends to roll further up the inclined face of chock 10 toward lip 12 thus increasing the wedge within the crack. The second embodiment of the present invention functions similarly.

Through experimentation, it has been determined that roller-chocks can be made in a wide range of sizes, from about a quarter of an inch up to the largest of any type of removable anchor device currently in use. Further, this design permits the use of the roller-chock in all types of cracks, both vertical and horizontal, flaring and parallel walled cracks, as well as holes and piton scars, unlike the two piece adjustable chock in the prior art shown in FIGS. 5*a* and 5*b*.

Figure 4A:
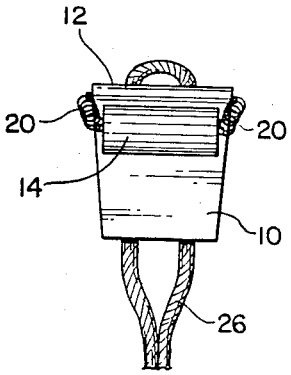
FIGS. 4*a, b,* and *c* are partial front plan views of the first embodiment of the present invention of FIGS. 1*a* and *b* which illustrate the interaction of the roller with the chock as the chock is rotated within a crack.
Figure 4B:
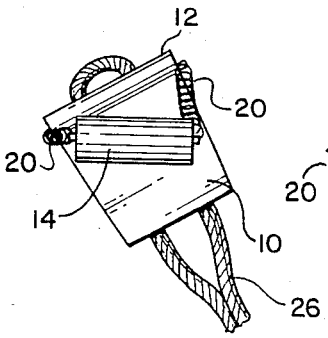
Figure 4C:
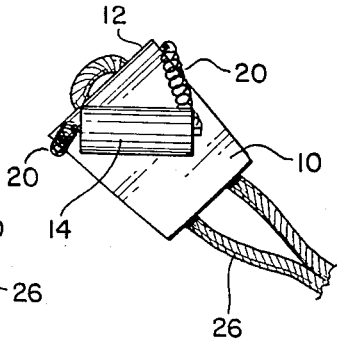

FIGS. 4*a*–4*c* and 8*a*–8*c* further illustrate the ability of the present invention to rewedge itself in a crack as anchor cable 26 is drawn through an arc as it would be, for example, as the climber climbs past the anchor point. In FIG. 4*a* chock 10 and roller 14 are shown with the main axis of roller 14 substantially parallel with the lip 12 of chock 10. In FIG. 4*b* anchor cable 26 is shown having been drawn through an arc of approximately 30° with roller 14 remaining in substantially the same position within the crack by camming across the face of chock 10 as chock 10 is rotated counterclockwise, thus stretching spring 20 on the right side more than spring 20 on the left. Finally, in FIG. 4*c* we can see that anchor cable 26 has been rotated through approximately 45° from its position in FIG. 4*a* and again roller 14 has remained substantially in the same position as in FIG. 4*a* with chock 10 having rotated through the greater angle also causing the right spring 20 to be stretched further than in the previous figure.

Figure 7A:
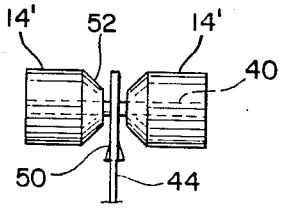
FIG. 7*a* is a plan view of an alternate design for the roller of the second embodiment of the present invention.
Figure 7B:
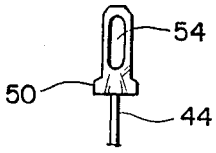
FIG. 7*b* is a side plan view of the roller coupler of the second embodiment of the present inventin.
Figure 8A:
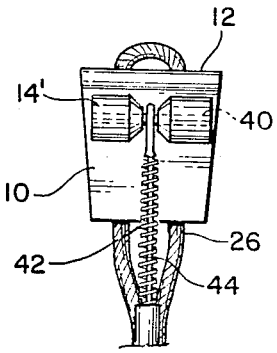
FIGS. 8*a, b* and *c* are partial plan views of the second embodiment of the present invention of FIGS. 6*a* and *b* which illustrate the interaction of the roller with the chock as the chock is rotated within a crack.
Figure 8B:
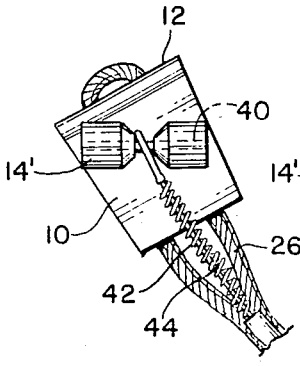
Figure 8C:
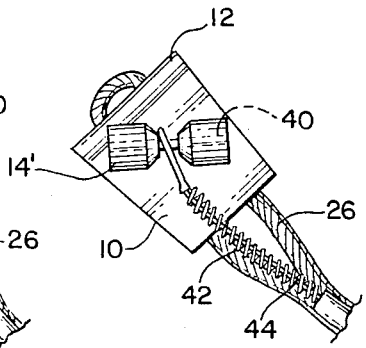

In FIG. 8*a* chock 10 and roller 14' are shown with the main axis of roller 14' substantially parallel with the lip 12 of chock 10. In FIG. 8*b* anchor cable 26 is shown having been drawn through an arc of approximately 30° with roller 14' remaining in substantially the same position within the crack by camming across the face of chock 10 as chock 10 is rotated counterclockwise, thus flexing release cable 44 and compressing spring 42. Finally, in FIG. 8*c* we can see that anchor cable 26 has been rotated through approximately 45° from its position in FIG. 8*a* and again roller 14' has remained substantially in the same position as in FIG. 8*a* with chock 10 having rotated through the greater angle causing release cable 44 to flex and spring 42 to compress further. To improve the rotational capabilities of the roller 14', the inner edges of the two halves of roller 14' can be beveled as shown in FIG. 7*a* and hole 54 through which roller pin 40 passes to interconnect roller coupler 50 to roller 14' could be elongated as shown in FIG. 7*b*. With the two section chock of FIGS. 5*a* and 5*b*, rewedging cannot occur since the two chock sections 60 and 62 are restricted to the same linear relationship one to the other by the dove-tail 80 between them. Thus it can be seen that the relative freedom of roller 14 or 14' with respect to the adjacent face of chock 10 provides a camming effect making the roller-chock very easy and quick to place without the necessity of looking for a particular location where the roller and the chock must stay in alignment as in FIG. 4*a* or 8*a*.

It is particularly important in rock climbing to be able to make a quick anchor placement since in many situations, the climber is required to hold the face of the rock merely by his toes and fingertips. With the roller-chock, he is able to make a quick and easy insertion into a crack of any description, and then, with a gentle tug on the anchor cable of the roller-chock to set it in place, he next then simply clips the anchor loop to his safety rope and continues the climb making the climb and route faster, safer and more enjoyable. This is not possible with many of the present devices available to a rock climber since he must, in the use of most of them, be able to see within the crack and pay particular attention to the placement of the device. This is not necessary with the roller-chock due to the orientation of the roller to the chock, and the use of a stiff anchor cable with the chock prevented from sliding down the cable by the epoxy.

Again, referring to FIGS. 2 and 3, if the roller-chock is placed in a horizontal crack, chock 10 should be placed with its free face downward to maximize its available gripping surface to the crack face. If placed with the roller downward, the chock may rock on the roller and break free of the upper face of the crack. Placed as shown in FIG. 2, chock 10 will move outwards due to a fall, and roller 14 will cam on the top side of chock 10 and move further into the crack. In addition, during a fall due to the mounting of roller 14 to chock 10 by means of two independent springs or release cable 44, spring 42 and roller coupler 50, the roller may angle across the face of chock 10 as shown in FIGS. 4*b* and, 4*c*, 8*b* and 8*c* since the cracks are not exactly parallel. Thus, allowing the roller-chock to cam to the best anchoring position. To prevent roller 14 from extending beyond the top edge of chock 10 and causing failure of the anchor, lip 12 is provided on the top edge of chock 10. In a vertical crack as shown in FIG. 3, the operation of the device is similar to that described with respect to a horizontal crack, however, in this type of crack, roller 14 rolls upward in the crack rather than deeper as discussed with respect to the horizontal crack.

Because of the stiffness of anchor cable 26, it is possible to place a roller-chock of the present design in a crack which is not visible to the climber. The crack may be above or below the climber's head or to the side of his body, and, because of the foot and finger hold that is available to the climber, he may not be able to move into position to fully view the crack.

To retrieve the roller-chock of the present design, the anchor cable 26, once tension is removed therefrom, may be rocked back and forth until it is loosened to some degree, then the anchor cable 26 may be pushed upward or deeper into the crack, depending upon the placement, while, at the same time, pulling down on pull ring 32 or release grip 48 to draw roller 14 toward anchor loop 34 and to reduce the effect of thickness of the roller-chock until it is freed.

The roller-chock of this design as discussed above, can be placed in several types of situations, is very lightweight and easily retrievable. Similar to the "friend," the roller-chock can be rotated once in place in a crack and still retain its anchoring ability. Unlike the "friend," the roller-chock can be made in much smaller sizes and it does not have a tendency to walk into a crack as does the "friend." If a fall occurs using the roller-chock, it may be necessary to give the chock a light tap with a chock clean-up tool before it can be pivoted and released. This is generally only necessary in a fall situation.

From the foregoing description, it will be apparent that the invention disclosed herein provides a novel and advantageous rock anchoring device. As will be understood by those familiar with the art, the invention may be embodied in other specific forms without departing from the spirit or essential characteristics thereof, and is only limited by the breadth and scope of the following claims.

What is claimed is:

1. A climbing aid for providing a removable anchor in a crack in a rock formation disposed for having the safety rope of the climber clipped thereto, said climbing aid comprising:

a wedge-shaped chock having two broad faces, two narrow sides, and a thick and a thin end;

anchor cable means having one end affixed to the thin end of the chock and defining an anchor loop at the other end disposed for clipping to the safety rope;

cylindrical roller means adjacent one broad face of the chock for effectively varying the overall thickness of the climbing aid;

spring means for maintaining the roller adjacent the face of, and biasing the roller toward the thick end of, the chock; and secondary cable means for manually drawing the roller down the face of the chock to reduce the overall thickness of the climbing aid to facilitate its placement in or withdrawal from the crack in the rock.

2. A climbing aid as in claim 1 wherein the two broad faces of the chock are planar.

3. A climbing aid as in claim 1 wherein:

said chock defines two cylindrical channels therethrough between the thick and thin ends; and said anchor cable means includes a single length of cable threaded through both channels in the chock and extending away from the thin end of the chock and a cable clamp connecting the free ends of the cable on to the other to define the anchor loop.

4. A climbing aid as in claim 1 wherein said spring means includes:

two pair of mounting pins, one affixed to each side of the chock near its thick end and one each affixed to each end of the roller; and a pair of coil springs, each spring joining the mounting pins on the adjacent side and end of the chock and roller.

5. A climbing aid as in claim 4 wherein said secondary cable means includes:

a bail connected between the mounting pins affixed to the ends of the roller;

a release cable having one end connected centrally to the bail; and a ring affixed to the other end of the release cable, the ring being dimensioned to receive at least one finger of the climber.

6. A climbing aid as in claim 5 wherein said secondary cable means further includes means for dressing the release cable along anchor cable means while allowing free movement of the secondary cable along its length.

7. A climbing aid as in claim 3 further includes means for preventing the chock from slipping on the cable of the anchor cable means.

8. A climbing aid as in claim 3 wherein the two broad faces of the chock are planar.

9. A climbing aid as in claim 4 wherein the two broad faces of the chock are planar.

10. A climbing aid as in claim 5 wherein the two broad faces of the chock are planar.

11. A climbing aid as in claim 7 wherein the two broad faces of the chock are planar.

12. A climbing aid as in claim 3 wherein said spring means includes:

two pair of mounting pins, one affixed to each side of the chock near its thick end and one each affixed to each end of the roller; and a pair of coil springs, each spring joining the mounting pins on the adjacent side and end of the chock and roller.

13. A climbing aid as in claim 1 wherein the chock further includes a lip formed along the thick end edge of the broad face thereof to which the roller is adjacent.

14. A climbing aid as in claim 2 wherein the chock further includes a lip formed along the thick end edge of the broad face thereof to which the roller is adjacent.

15. A climbing aid as in claim 4 wherein the chock further includes a lip formed along the thick end edge of the broad face thereof to which the roller is adjacent.

* * * * *